US005385263A

United States Patent [19]

Kirk et al.

[11] Patent Number: 5,385,263

[45] Date of Patent: Jan. 31, 1995

[54] COMPRESSED GAS MOBILE STORAGE MODULE AND LIGHTWEIGHT COMPOSITE CYLINDERS

[75] Inventors: Kenneth G. Kirk, Placerville; Leonard Schoenman, Citrus Heights; Kris E. Baxter; John B. Mouritsen, both of El Dorado Hills, all of Calif.

[73] Assignee: Aerojet-General Corporation, Rancho Cordova, Calif.

[21] Appl. No.: 236,735

[22] Filed: May 2, 1994

[51] Int. Cl.[6] ..... B65D 8/08

[52] U.S. Cl. ..... 220/589; 206/443; 206/446; 220/586; 220/23.83

[58] Field of Search ..... 220/586, 588, 587, 589, 220/590, 581, 23.86, 23.83; 206/386, 446, 443

[56] References Cited

U.S. PATENT DOCUMENTS

| | | | |
|---|---|---|---|
| 2,693,291 | 1/1954 | Alderfer | 220/589 |
| 3,047,191 | 7/1962 | Young | 220/588 |
| 3,296,802 | 1/1967 | Williams | 220/588 |
| 3,750,823 | 8/1973 | Carter et al. | 220/589 |
| 4,053,081 | 10/1977 | Minke | 220/589 |
| 5,025,943 | 6/1992 | Forsman | 220/583 |

*Primary Examiner*—Joseph Man-Fu Moy
*Attorney, Agent, or Firm*—Townsend and Townsend Khourie and Crew

[57] ABSTRACT

Lightweight compressed gas cylinders are incorporated into a module which contains manifolding and which is designed for easy loading, unloading and transport on a flat-bed truck or other vehicle, particularly a roll-on roll-off transport truck, which is a specialized truck for mechanized handling of large containers. The module eliminates the need to retain the vehicle itself at the site of use. While a variety of cylinders of composite construction to achieve light weight can be used, certain novel composite cylinders whcih are particularly useful are also disclosed. These cylinders have a lightweight metallic liner or core cylinder wrapped with three layers of wound fiber. The inner and outer layers are axially-wound glass fiber and the intermediate layer is hoop-wound carbon fiber.

16 Claims, 4 Drawing Sheets

COMPRESSED GAS MOBILE STORAGE MODULE AND LIGHTWEIGHT COMPOSITE CYLINDERS

The field of technology to which this invention pertains is that of transportable containers for compressed gases, and in particular, systems and modules entailing several individual cylinders of compressed gas. This invention also pertains to particular compressed gas cylinders of composite construction.

BACKGROUND OF THE INVENTION

Compressed gas is transported and used in elongated cylinders which are capable of retaining the high pressure of the gas and which meet all regulatory requirements for safety during storage, transport and use. It is critical that these cylinders be able to contain pressure in all directions, including both axial loads (force components parallel to the cylinder axis) and hoop loads (radially directed tome components). For operations where large volumes of compressed gas or a continuous supply is required, cylinders are used which generally measure about 20–40 feet in length and about 1–2 feet in diameter. To contain loads in cylinders of this size, a particularly strong construction is needed. As a result, a common material of construction is high-strength steel. Banks of eight to twelve of these cylinders are usually mounted to truck trailers for transport to sites of usage.

Because of the high density of steel, these cylinders are not readily removable from the trailers by the type of equipment available at the typical site of use. The cylinders are therefore mounted permanently to the trailers. Unfortunately, this requires that the trailer remain at the site of use for the full time that the cylinders are needed. This gives rise to ongoing expenses associated with the trailer itself, such as excise taxes, licensing fees, and costs arising from operational maintenance. Also, while the trailer is at the site of use, it is not available for transporting other cylinders or gases, and the cost of the value of this lost time is frequently borne by the site. Finally, the permanent mounting of the cylinders to the trailer limits the trailer to a single type of compressed gas, requiring different trailers for different gases and different numbers of cylinders.

SUMMARY OF THE INVENTION

The present invention offers a dual approach to the problems noted above.

In one aspect, the invention resides in a mobile storage module which consists of an assembly of high-pressure lightweight compressed gas cylinders mounted inside a common frame which includes manifolding and which is readily removed from the transporting vehicle at the site of use. The light weight of the cylinders is achieved by a wound fiber construction, utilizing low density, high strength fibers of any of a variety of materials, either alone or in combination, and either in single or multiple layers. The fiber winding imparts axial and hoop strength to the cylinder while avoiding the weight of steel. In certain embodiments of this concept, the fibers are wound over a liner or inner core cylinder; in others the cylinder consists entirely of the fibers, having been formed over a mandrel which was subsequently removed.

The module includes a base frame with bulkheads mounted to each end. The bulkheads support the cylinders by their two ends. The module also includes a manifold at one end for delivery of the gases from the cylinders, preferably in such a manner that the cylinders are grouped in subcombinations, the cylinders in any given subcombination leading to a common delivery valve. This permits cylinders to be isolated when not in use, and the selection of certain cylinders to the exclusion of others. Selection in this manner is particularly useful in staging of the pressures among the various cylinders, i.e., different groups of cylinders containing gases at different pressures. Staging in this manner permits a coordinated delivery of the gas as the pressure drops in one or more groups of cylinders during the course of use. In further preferred embodiments of the invention, the manifold also contains pressure and/or temperature relief valves for each cylinder and appropriate vent tubing to meet regulatory requirements. In still further embodiments, the module is a combination of submodules created by dividing the bulkheads into subsections, each subsection configured to support a small number (2 to 6, for example) of cylinders, and to be removably secured to other subsections to achieve combinations capable of supporting multiples of the cylinders. This permits one to readily adapt and modify modules to accommodate different numbers of cylinders by building up bulkhead sections.

The modules of the present invention are preferably provided with wheels or rollers as well as loops or similar engagement members which make them compatible with vehicles commonly known as "roll-on roll-off transport trucks." A truck of this type contains a tilting bed and a hydraulic winch, both operated from the truck cab and permitting the truck to self-load or -unload any of a variety of payloads. Trucks of this type have been used in the prior art for uses ranging from the handling of dumpsters to the transportation of solid hazardous waste material, and are now, by virtue of the module of the present invention, useful for compressed gas and compressed gas cylinders as well. The module is also suitable for loading on and transport by other conventional trucks and truck configurations, as well as rail cars and sea-going vessels.

In a second aspect, the invention resides in a particular composite cylinder construction which includes a core cylinder of low-density material, such as metal or plastic, surrounded by at least three layers of fiber winding to provide axial strength and hoop strength, while minimizing or eliminating corrosion. Of the minimum three layers, the inner layer, i.e., the layer closest to the metallic core cylinder, is glass fiber, wound in a predominantly axial direction. The intermediate layer is carbon fiber, wound in a predominantly circumferential direction. The outer layer, like the inner layer, is glass fiber, again wound in a predominantly axial direction. Other layers may also be included, either outside this group of three, or between two of the three.

The hoop-wound carbon fiber is selected for its high strength, since the cylinder is most vulnerable to the hoop component of the load exerted on it. The inner layer of glass fiber, in addition to providing axial stength, provides electrical insulation between the cathodic carbon fiber and the metallic core cylinder, thereby avoiding corrosion which might arise from the presence of the carbon fiber. The outer layer of glass fiber, while adding to the axial reinforcement provided by the inner layer, protects the relatively brittle carbon fiber from contact damage. The inclusion of glass fiber further provides a cost advantage, since glass fiber is considerably less costly than carbon fiber.

These and other features and advantages of both aspects of the present invention will be apparent from the description which follows.

DETAILED DESCRIPTION OF THE INVENTION AND PREFERRED EMBODIMENTS

Figure 1:
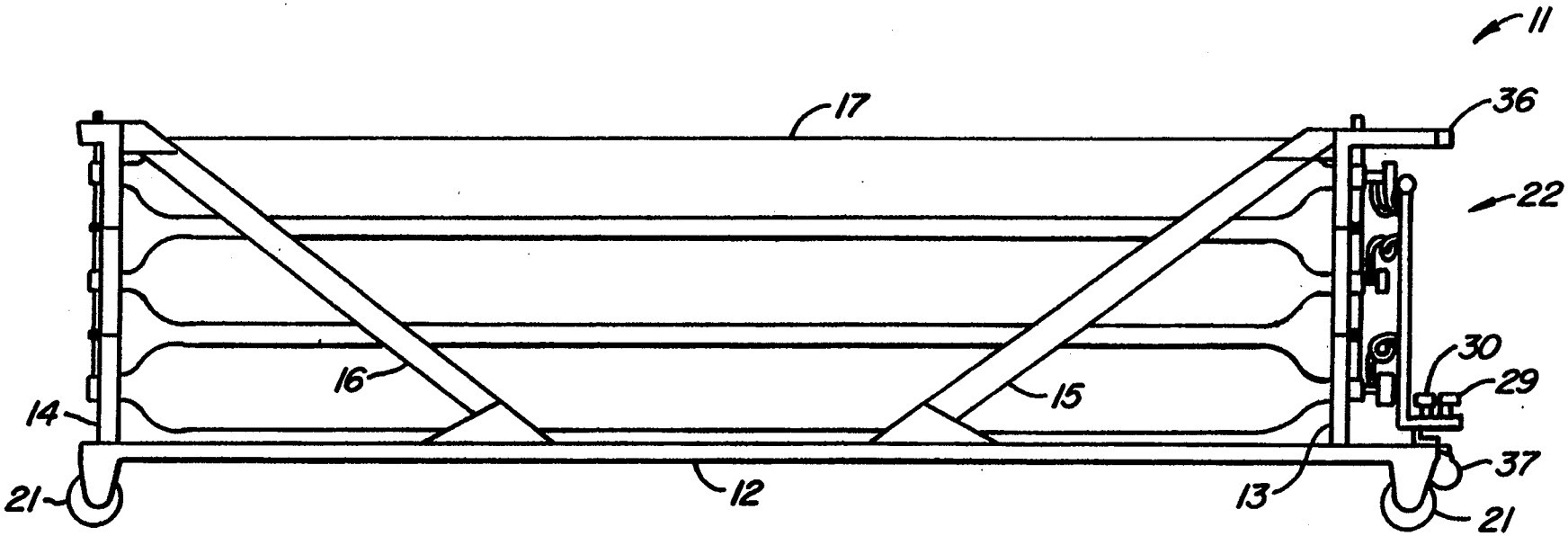
FIG. 1 is a side view of a compressed gas cylinder module in accordance with the present invention.

While the invention is generic in scope, its parameters will best be understood by a detailed description of certain specific embodiments, as shown in the drawings and discussed below.

One example of a module in accordance with the present invention is shown in FIG. 1, which depicts the module 11 in a side view. The module includes a base 12, and a forward bulkhead 13 and rear bulkhead 14 permanently mounted to the base and stabilized by angled bars 15, 16. Identical angled bars are included on the opposite side of the module (not visible in this view). Spanning the distance between the bulkheads are a bank of compressed gas cylinders 17, each of which is supported at both ends solely by the bulkheads.

The cylinders in this particular module are arranged in three horizontal rows. In general, modules in accordance with this invention may contain any number of cylinders, although most often the number will be from 2 to 20. Preferred modules are those containing six or more cylinders, arranged in horizontal rows of 2 to 6 cylinders per row, preferably 2 to 4. In further preferred arrangements, each bulkhead is made up of subsections stacked vertically, each subsection supporting one row of cylinders. The module may therefore consist of a single subsection, thereby containing a single horizontal row, or two or more subsections, eaching forming a separate horizontal row. Modules this type can thus be modified or adapted to meet specific needs by simply adding or removing subsections. The module shown in FIG. 1 is comprised of three subsections, one subsection forming each of the three rows. The subsections can be bolted together in any conventional manner, such as by bolts joining a horizontal flange at the upper edge of one subsection to a horizontal flange at the lower edge of the next higher subsection. Alternatively, the sections can be individually bolted to upright posts behind each bulkhead. Various other possibilities will be readily apparent to those skilled in the art.

The base 12 of the module rests on four wheels or rollers 21, one at each corner, permitting the module to be rolled on or off a truck bed as well as rolled into position on a ground surface. A manifold 22 is mounted on the forward end of the module, for delivery of the compressed gas from the cylinders and for such additional functions as filling the cylinders, venting the cylinders for safety purposes, and monitoring the temperature and pressure of the cylinders.

Figure 2:
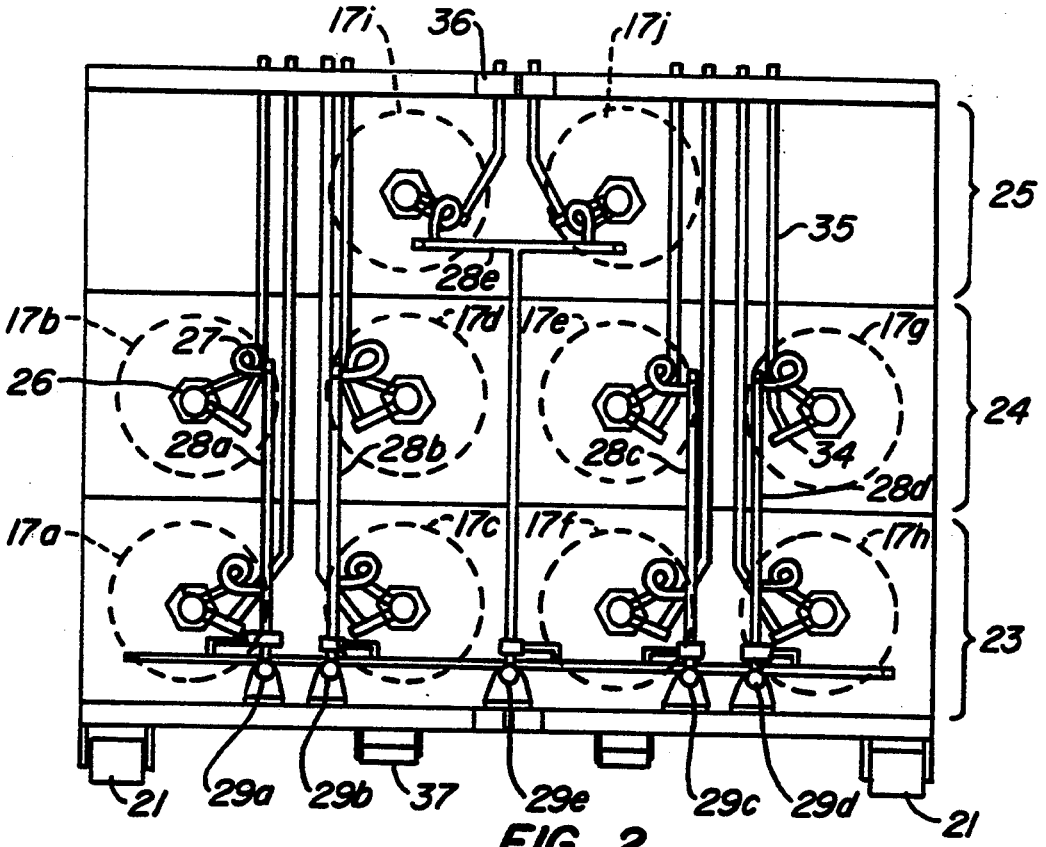
FIG. 2 is a front end view of the module of FIG. 1, showing the delivery manifold.

A front elevation of the manifold on the forward end of the module is seen in FIG. 2. This view also shows the three subsections 23, 24, 25 of the forward bulkhead. The peripheries of the gas cylinders 17 are shown in dashed lines, and it will be noted that the lowest row contains four cylinders, the middle row also contains four cylinders, and the upper row contains only two.

The manifold shown in the drawing is one example of a typical manifold for delivering gas from the cylinders and providing vent lines for safety relief valves. Each cylinder terminates in a cylinder valve 26, which, in the manifold shown in the drawing, is joined by a looped length of tubing 27, commonly referred to as a "pigtail," to a straight section of pipe 28 which leads to a delivery valve 29, the outlet of which is ready for connection to the supply point at the site of use. The connections within the manifold are arranged such that the cylinders are grouped in mutually exclusive subcombinations, each subcombination directed to a separate delivery valve. In preferred embodiments of the invention, these subcombinations are 2 to 4 cylinders each; in the manifold shown in FIG. 3, each subcombination is two cylinders. In the lower and middle rows, the two leftmost cylinders **17*a* and 17*b* feed a common pipe 28*a* which leads to a single delivery valve 29*a*. Likewise, the adjacent vertical pair of cylinders 17*c* and 17*d* feed a second common pipe 28*b* leading to a second delivery valve 29*b*. The next adjacent vertical pair 17*e*, 17*f* in the same two rows feed a third pipe 28*c* leading to a third delivery valve 29*c*. The rightmost vertical pair 17*g*, 17*h* in the same two rows feed a fourth pipe 28*d* leading to a fourth delivery valve 29*d*. Finally, the two cylinders in the top row 17*i*, 17*j* feed a fifth pipe 28*e* leading to a fifth delivery valve 29*e***. These groups of two cylinders each and the lines leading to them and isolating them from each other make it possible to fill each group at a different pressure. This permits the advantage of a staged delivery when desired, as well as the filling of one group while another is being used.

A sixth pipe **28*f* joins each of the first five pipes 28*a*, 28*b*, 28*c*, 28*d*, 28*e* through valves 30 directly behind each delivery valve 29*a*–29*e*, for purposes of combining the subcombinations or rerouting gases from any of the cylinders to any of the delivery valves. The valves 30 are visible in the side view shown in FIG. 1**.

A safety relief device 34 is also mounted on each cylinder, leading to a vent line 35. The bulkhead itself also contains various loops 36 and/or additional rollers 37 to provide means for engagement of the module with cables or other devices on a truck.

Figure 3:
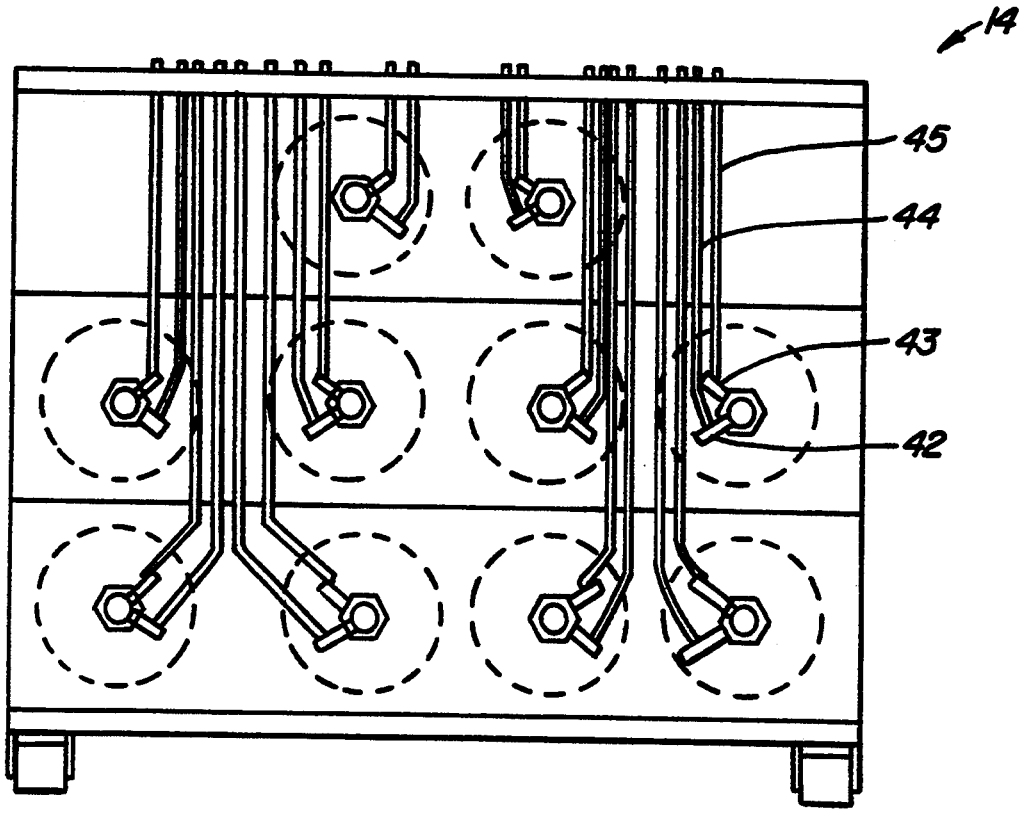
FIG. 3 is a rear end view of the module of FIG. 1.

The rear bulkhead 14 is shown in FIG. 3. The rear end of each cylinder contains two relief valves 42, 43, each of which vents through a separate vent line 44, 45. One of the relief valves may be a temperature relief valve, for example, and the other a pressure relief valve.

Figure 4:
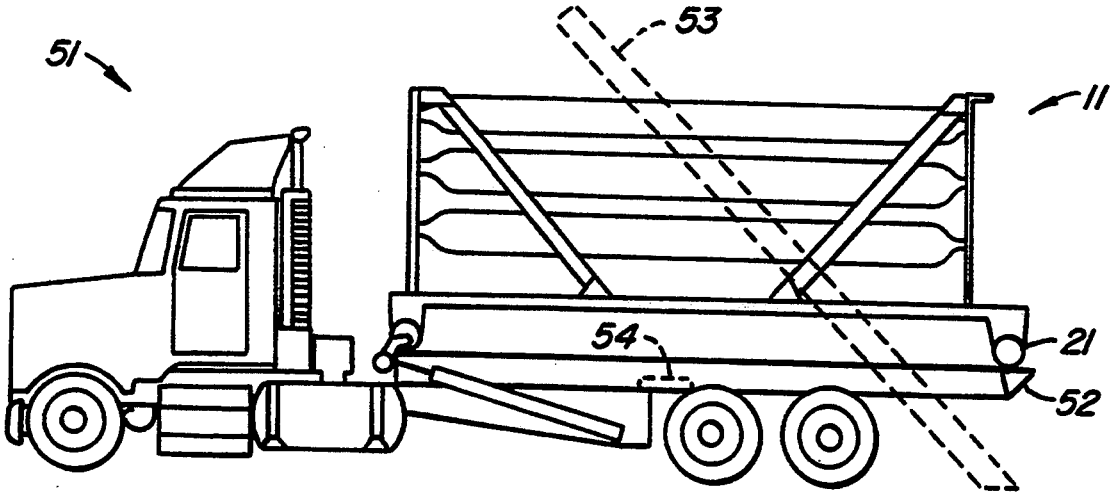
FIG. 4 is a side view of a transport truck with the module of FIG. 1 mounted on the truck bed.

FIG. 4 shows the module 11 loaded onto a self-loading roll-on roll-off transport truck 51. The wheels 21 of the module rest on the truck bed 52, and the module is temporarily secured in place by latches on the truck bed, not shown in the drawing. The truck bed 52 is cabale of being tilted into the position shown in dashed lines 53, and a hydraulic winch 54 permits the module to roll off the truck bed backwards, or draws the module onto the truck bed from a position on the ground behind the truck. Trucks of this type are widely used in transporting materials, particularly hazardous wastes, and the operation of this type of truck is well known among those skilled in the transportation of industrial materials.

Modules within the scope of the invention can be used in a variety of ways. For example, a module can be filled with gas at one location, transported to a second location for use and left at that location until the gas is depleted, then returned to the first location for refilling. Alternatively, the module can be refilled at the user location from a transportable source or from a compressor.

Cylinders for use with the module will generally be light weight cylinders at least about ten feet (3 m) in length and weighing less than about 100 pounds per foot of length (149 kg/m). Preferably, the cylinders are at least about fifteen feet in length (49 m) and from about 50 to about 75 pounds per foot of length (74 to 112 kg/m). The fibers may be wound over a molded or cast liner of solid material such as metal or plastic, or they may constitute the entire thickness of the cylinder. Fiber materials of particular interest are carbon fibers and glass fibers, and the fibers may be broad, such as tapes, or of circular cross section, such as filaments. A single type of fiber may be used, or a combination of fibers of different materials and tensile strengths. When a combination is used, the fibers may be separated in layers, or co-wound in the same layer. The direction of the fibers will preferably include both axially-wound fibers and hoop-wound fibers, to provide both axial and hoop reinforcement, respectively, and these two winding directions may occur in a common layer or in alternate layers.

Turning now to the second aspect of this invention, this resides in a composite cylinder of a particular novel construction. This aspect of the invention is illustrated in the half-cylinder cross section of FIG. 5 and the view in FIG. 6.

Figure 5:
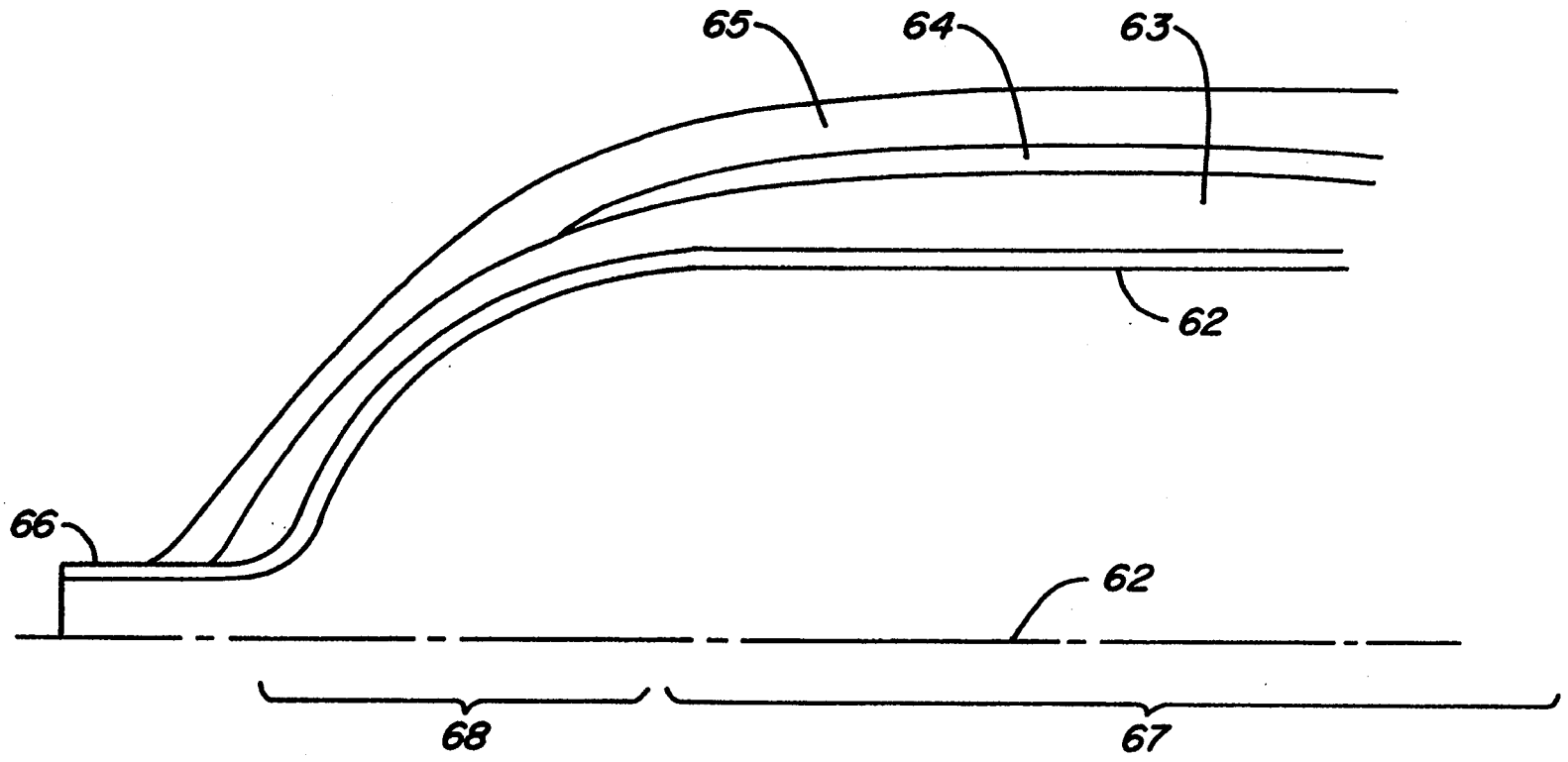
FIG. 5 is a view of a compressed gas cylinder in accordance with the present invention, shown in cross section along the longitudinal axis of the cylinder.

FIG. 5 shows the center line 61 or longitudinal axis of the cylinder, the metallic core 62, and each of the three layers of wound fiber 63, 64, 65. An external view of the three layers appears in FIG. 6.

The metallic core is fabricated of a lightweight metal, preferably one with a density significantly less than that of steel. Preferred metals are those with densities of less than about 5.0 grams per cubic centimeter (i.e., less than about 312 pounds per cubic foot), and particularly preferred are those metals with densities of less than about 3.0 grams per cubic centimeter (less than 187 pounds per cubic foot). The metal may be a pure metal or an alloy. Preferred metals are aluminum and aluminum alloys. The thickness of the metallic core may vary. In most applications, appropriate thicknesses will range from about 0.1 inch to about 0.4 inch (0.25–1.0 cm). In the presently preferred implementation of this invention, the aluminum alloy is 6061-T6 and the thickness of the metallic core is 0.25 inch (0.64 cm). The length and circumference of the metallic core may vary as well. The present invention will be of greatest use with metallic core cylinders ranging from about 10 feet to about 30 feet (3–9 m) in length, and from about 15 inches to about 48 inches (38–122 cm) in diameter. The presently preferred metallic core cylinder is 20 feet (6.1 m) in length and 22 inches (56 cm) in diameter.

Figure 6:
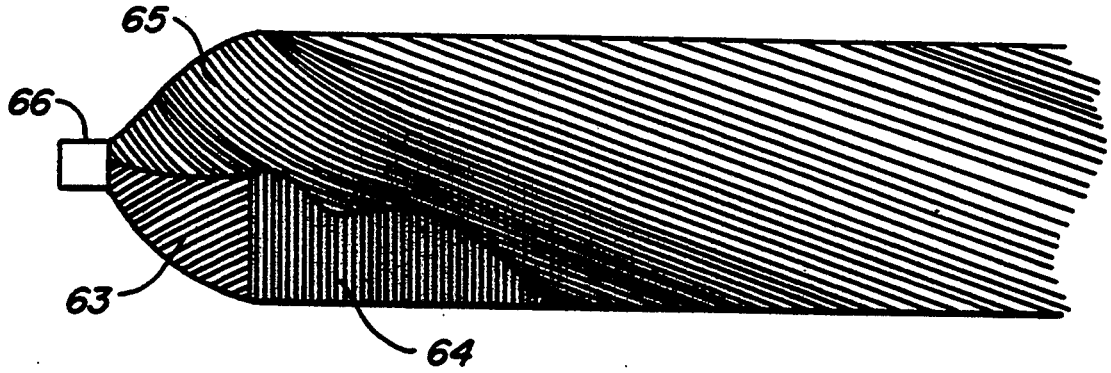
FIG. 6 is an external view of the compressed gas cylinder of FIG. 5, with part of the outer winding layer removed to show the winding layers underneath.

The three wound fiber layers together cover the entire surface area of the cylinder except for the neck 66 at either end, where the bare metal is exposed. The inner layer 63 and outer layer 65 cover the entire cylinder up to the neck, including the central cylindrical portion 67 and the curved domes 68 at each end. The passage of the winding over the domes permits the winding to be axially oriented, i.e., with the fibers oriented in directions predominantly parallel to the longitudinal axis 61 of the cylinder. By "axial orientation" and "predominantly parallel to the longitudinal axis" is meant that the angle of the fibers along the central cylindrical portion 67 of the cylinder is closer to being parallel to the axis than perpendicular to it, as shown in FIG. 6. As is readily understood by those skilled in the art, it is not possible to wind the fibers exactly perpendicular to the axis since the fibers must be wound around the cylinder to provide strength reinforcement to the cylinder, and the domes 68 are small relative to the length of the entire cylinder. The fibers will generally follow a helical path around the cylinder from one dome to the other. The helical winding at a angle less than 45° with the cylinder axis provides axial strength to the cylinder.

The winding of the inner layer 63 and outer layer 65 are shown in opposite directions in FIG. 6. This is optional. Alternatively, the winding in these two layers may be in the same direction. The thicknesses of the two layers may also vary, although in general the total thickness of the two layers (excluding the intermediate carbon fiber layer 64) will be any thickness which increases the capacity of the cylinder to withstand axial stress. Furthermore, the thickness of the inner layer 63 will preferably be sufficient to provide complete electrical insulation between the metallic core 62 and the carbon fiber layer 64. The thickness of the outer layer 65 will preferably be sufficient to protect the carbon fiber layer 64 from physical damage upon contact with sharp or abrasive objects. A range of preferred thicknesses for the inner layer 63 is about 0.1 inch (0.25 cm) to about 0.5 inch (1.3 cm), and the same range applies to the outer layer 65. In the presently preferred embodiment, the thicknesses are 0.25 inch (0.64 cm) for each of these two layers. These thickness refer to the portion of the layer which resides over the central cylindrical portion 67 of the cylinder, since the layers tend to be thicker at the domes 68. The particular type of glass fiber presently preferred is E-Glass, which is a class of glass fiber, with a minimum tensile strength of 200,000 psi. Examples of suppliers of this class of glass fiber are Owens-Coming Fibreglas Corp., Toledo, Ohio, and Certain Teed Corporation, Valley Forge, Pa. (VETROTEX line of glass fibers).

The carbon fiber and the glass fiber are not co-wound, but are instead segregated in separate layers. Unlike the glass fiber layers 63 and 65, the carbon fiber layer 64, as shown in FIG. 6, is wound in the hoop direction, i.e., oriented in directions predominantly circumferential relative to the metallic core cylinder 62. By "hoop direction" and "predominantly circumferential" is meant that the angle of the fiber is closer to being perpendicular to the cylinder axis 61 than to being parallel. Again, as will be readily understood by those skilled in the art, it is not possible to achieve a strictly circumferential direction with a continuous winding of the fiber, but the actual direction is at most within a few degrees of circumferential and the winding provides a much greater reinforcement to the hoop strength of the cylinder than to the axial strength. Furthermore, as seen in both FIGS. 5 and 6, the carbon fiber layer does not extend to any significant distance beyond the central cylindrical portion 67 of the cylinder. This is primarily for purposes of economy, since the hoop load is borne mostly by this section of the cylinder, and the carbon fiber is generally more costly than the glass fiber.

The thickness of the carbon fiber layer may vary, but in any case will be sufficient to achieve a substantial increase in the hoop strength of the cylinder. A range of preferred thickness for the carbon fiber layer is about 0.1 inch (0.25 cm) to about 0.5 inch (1.3 cm). The carbon fiber layer will generally taper toward the ends of the layer. These thickness figures refer to the non-tapering portion of the layer. In presently preferred constructions, the thickness is 0.25 inch (0.64 cm), and the particular type of carbon fiber which is presently preferred is carbon fiber with a minimum tensile strength of 700,000 psi. Examples of such fibers and their suppliers are G30-700 carbon fiber, Toho Chemical Industry Co., Ltd., Tokyo, Japan, and T-700 carbon fiber, Toray Industries, Inc., Tokyo, Japan.

The two types of fiber differ not only in cost but also in modulus of elasticity. Glass fiber generally has a lower modulus than carbon fiber, and hence the use of carbon fiber for reinforcing the hoop strength of the cylinder, since the hoop load is generally greater than the axial load. Preferred glass fibers are those having a modulus of less than about $15\times10^6$ psi (103 mPa), and most preferably from about $5\times10^6$ psi (34 mPa) to about $10\times10^6$ psi (59 mPa). Preferred carbon fibers are those having a modulus of greater than about $25\times10^6$ psi (172 mPa), and most preferably from about $30\times10^6$ psi (207 mPa) to about $50\times10^6$ psi (345 mPa). Fibers presently contemplated are those having a modulus of between $7\times10^6$ and $10\times10^6$ psi (48–59 mPa) (glass) and between $30\times10^6$ and $40\times10^6$ psi (207–276 mPa) (carbon).

The foregoing is offered primarily for purposes of illustration. It will be readily apparent to those skilled in the art that the arrangements and configurations of the module components, the materials used in construction of the cylinders, the methods of use and other parameters of the invention described herein may be further modified or substituted in various ways without departing from the spirit and scope of the invention.

What is claimed is:

1. A compressed gas cylinder module comprising:

(a) front and rear bulkheads mounted in upright position to a wheeled base frame;

(b) a plurality of cylindrical containers for containment of compressed gas, each said cylindrical container being at least about ten feet in length and weighing less than about 100 pounds per foot of length with a wall comprising wound fiber material to provide axial strength and hoop strength to said cylinder, each said cylindrical container having first and second ends, said first end mounted to said front bulkhead, and said second end mounted to said rear bulkhead; and (c) a manifold of piping at said front bulkhead joining said cylindrical containers to a plurality of outlet valves such that each said outlet valve is fed by compressed gas from selected combinations of said cylindrical containers;

said module adapted for removable placement on a transport truck bed.

2. A compressed gas cylinder module in accordance with claim 1 in which said plurality of cylindrical containers is from 2 to 20 in number.

3. A compressed gas cylinder module in accordance with claim 1 in which said plurality of cylindrical containers is at least six in number, and said manifold is arranged such that each of a plurality of mutually exclusive subcombinations of 2 to 4 cylindrical containers is directed to a separate outlet valve.

4. A compressed gas cylinder module in accordance with claim 1 in which said manifold includes a vent tube for each cylindrical container.

5. A compressed gas cylinder module in accordance with claim 1 in which said manifold includes a forward vent tube for each cylindrical container, and affixed to said rear bulkhead is a rear vent tube for each cylindrical container.

6. A compressed gas cylinder module in accordance with claim 1 further comprising engaging means affixed to one of said forward and rear bulkheads for attachment of a winch-driven cable on said transport truck bed.

7. A compressed gas cylinder module in accordance with claim 1 in which said front and rear bulkheads are each comprised of a plurality of separable subsections, and with from two to six cylindrical containers mounted to each said subsection.

8. A compressed gas cylinder module in accordance with claim 1 in which each said cylindrical container has a longitudinal axis and is comprised of a composite of wound glass and carbon fibers including windings oriented in directions predominantly parallel to said longitudinal axis plus windings oriented in directions predominantly circumferential relative to said cylindrical container.

9. A compressed gas cylinder comprising:

(a) a cylindrical core of a metallic material having a density of less than about 5.0 grams per cubic centimeter and having a longitudinal axis;

(b) first and second layers over said cylindrical core, said first and second layers being of wound glass fiber having a modulus of elasticity of less than about $15\times10^6$ psi and oriented in directions predominantly parallel to said longitudinal axis; and (c) a third layer interposed between said first and second layers, said third layer being of wound carbon fiber having a modulus of elasticity of greater than about $25\times10^6$ psi and oriented in directions predominantly circumferential relative to said cylindrical core.

10. A compressed gas cylinder in accordance with claim 9 in which said metallic material of said cylindrical container has a density less than about 3.0 grams per cubic centimeter.

11. A compressed gas cylinder in accordance with claim 9 in which said metallic material of said cylindrical container is aluminum or an aluminum alloy.

12. A compressed gas cylinder in accordance with claim 9 in which said glass fiber has a modulus of elasticity of from about $5\times10^6$ to about $10\times10^6$ psi.

13. A compressed gas cylinder in accordance with claim 9 in which said carbon fiber has a modulus of elasticity of from about $30\times10^6$ to about $50\times10^6$ psi.

14. A compressed gas cylinder in accordance with claim 9 in which said metallic material of said cylindrical container is aluminum or an aluminum alloy, said glass fiber has a modulus of elasticity of from about $5\times10^6$ to about $10\times10^6$ psi, and said carbon fiber has a modulus of elasticity of from about $30\times10^6$ to about $50\times10^6$ psi.

15. A compressed gas cylinder in accordance with claim 9 comprised of a central cylindrical section terminated at both ends by dome-shaped sections, and said first and second layers cover said cylindrical section and said dome-shaped sections, and said third layer covers said cylindrical section only.

16. A compressed gas cylinder in accordance with claim 9 comprised of a central cylindrical section terminated at each end by a dome-shaped section joining said central cylindrical section to a cylindrical neck section of substantially lesser diameter than said central cylindrical section, said cylindrical neck section not being covered by any of said first, second or third layers.

* * * * *